US006662857B2

(12) United States Patent
Willfort et al.

(10) Patent No.: US 6,662,857 B2
(45) Date of Patent: Dec. 16, 2003

(54) MOLD COMPRISING OUTER MOLD PARTS AND MOLDING MATERIAL CORES INSERTED INTO SAME

(75) Inventors: Peter Willfort, Linz (AT); Horst Bohn, Linz (AT)

(73) Assignee: VAW mandl & berger GmbH (AT)

( * ) Notice: Subject to any disclaimer, the term of this patent is extended or adjusted under 35 U.S.C. 154(b) by 35 days.

(21) Appl. No.: 09/837,812

(22) Filed: Apr. 19, 2001

(65) Prior Publication Data

US 2002/0134525 A1 Sep. 26, 2002

(30) Foreign Application Priority Data

Apr. 19, 2000 (DE) ..... 100 19 310

(51) Int. Cl.[7] ..... B22D 33/04; B22D 37/00; B22C 9/10

(52) U.S. Cl. ..... 164/340; 164/136; 164/137; 164/30

(58) Field of Search ..... 164/137, 30, 31, 164/133, 136, 369, 340, 370

(56) References Cited

U.S. PATENT DOCUMENTS 5,704,413 A 1/1998 Takasaki et al. ..... 164/136
5,819,837 A * 10/1998 Hugo et al. ..... 164/136
5,954,113 A * 9/1999 Buchborn ..... 164/120

FOREIGN PATENT DOCUMENTS

| | | | |
|---|---|---|---|
| DE | 3018782 | A1 | 12/1980 |
| DE | 2746233 | C2 | 10/1983 |
| DE | 3543194 | C1 | 11/1986 |
| DE | 4434139 | C1 | 8/1995 |
| DE | 195 31 551 | A1 | 3/1997 |
| DE | 196 07 805 | C1 | 7/1997 |
| EP | 0 280 675 | | 2/1988 |
| EP | 0 280 675 | A1 | 8/1988 |
| EP | 0 234 877 | B1 | 12/1989 |
| EP | 0486463 | A2 | 5/1992 |
| JP | 2-127957 | * | 5/1990 |
| WO | WO 97/07914 | | 3/1997 |
| WO | WO 00/13819 | | 3/2000 |

* cited by examiner

*Primary Examiner*—Kuang Y. Lin
(74) *Attorney, Agent, or Firm*—Harness, Dickey & Pierce, P.L.C.

(57) ABSTRACT

A mold has outer mold parts and inserted molding material cores. Together, the parts and cores form a mold cavity. The inner cores of molding material are arranged in several layers one above the other. The inner cores are clamped in between the outer mold parts and a final covering core of mold material. A continuous clamping force is applied between the parts and cores. The mold cavity is formed by surfaces of the outer mold, surfaces of the inner cores and the covering core.

10 Claims, 3 Drawing Sheets

MOLD COMPRISING OUTER MOLD PARTS AND MOLDING MATERIAL CORES INSERTED INTO SAME

CROSS-REFERENCE TO RELATED APPLICATIONS

This application is based upon and claims priority to German Patent Application 100 19 310.2 filed Apr. 19, 2000, which application is herein expressly incorporated by reference.

FIELD AND BACKGROUND OF THE INVENTION

The present invention relates to a mold with outer mold parts and inserted mold material cores. Together, the outer mold parts and material cores form a mold cavity. The outer mold parts can be part of a permanent mold and/or molding material parts/outer cores.

To produce complicated moldings, such as cylinder heads, it is necessary to insert molding material cores into the outer mold parts. It is also known to use outer molding material cores. Thus, substantial parts of the outer casting faces are not formed by a metallic mold wall. These parts are formed by outer cores of molding material. This method is particularly suitable for casting aluminum and magnesium alloys.

SUMMARY OF THE INVENTION

It is an object of the present invention to provide a mold which can be used for complicated castings. In particular, the mold is suitable for rotary casting.

The inner cores including molding material are stacked in layers one above the other. The inner cores are clamped between the outer mold parts and the final covering core of molding material. A continuous force, a going-through uninterrupted force, is applied between the covering core, the inner cores, and the outer mold parts. The mold cavity is formed by surfaces of the outer mold parts, surfaces of the inner cores and the covering core. In accordance with the invention, additional means are not provided to fix the molding material cores in the outer mold cores and to fix the molding material cores between each other. The multi-layer structure enables the production of complicated shapes. By using the final covering core, which is comprised of molding material, it is possible to directly connect a casting container. The covering core preferably comprises at least one ingate aperture and at least one gas exit aperture.

According to a further embodiment, the parts of the mold include a base plate and several side parts. The side parts are movable relative to the base plate. The side parts may include two longitudinal side parts. The longitudinal side parts, relative to the base plate, can be displaced outwardly away from the mold cavity in opposite directions. At least one end side part, relative to the base plate, can be pivoted outwardly away from the mold cavity. This measure enables a problem-free structure of the inner cores, which includes several stacked layers. The inner faces of the side parts may include projections which hold additional individual inner cores relative to the base plate. Displaceable bolts or pivotable claws may be arranged at the base plate or at least at two side parts to secure the covering core. The bolts or claws hold the package of molding material cores within a mold such that, even when the mold rotates, displacements between the inner cores cannot occur.

An inventive mold is used in a particularly advantageous way if the mold is first stacked on the base plate and then rotated by about 180° around a horizontal axis. The covering core, which includes an ingate aperture, comes downward to rest. Subsequently, a casting container filled with melt for one casting operation is coupled to the covering core. When the assembly is again rotated by 180° around the horizontal axis, the melt flows through the ingate aperture in the covering core into the mold cavity. Thereafter, the melt container is removed and the casting solidifies. After solidification, the mold is removed. The mold is preferably rotated around an axis which extends parallel to the longitudinal extension of the mold cavity.

The base plate is provided in the form of a permanent mold part. Ordinarily, the base plate is metal. The outer mold parts can also be permanent mold parts mechanically connected to the base plate. Also, the outer mold parts can be molding material parts. In this case, mechanical clamping means clamp the parts onto the base plate from the sides and from above. Also, the clamping means is connected to the base plate.

From the following detailed description, taken in conjunction with the drawings and subjoined claims, other objects and advantages of the present invention will become apparent to those skilled in the art.

BRIEF DESCRIPTION OF THE DRAWINGS

An embodiment of the invention is illustrated in the drawings and described below.

DETAILED DESCRIPTION OF THE PREFERRED EMBODIMENTS

Figure 1:
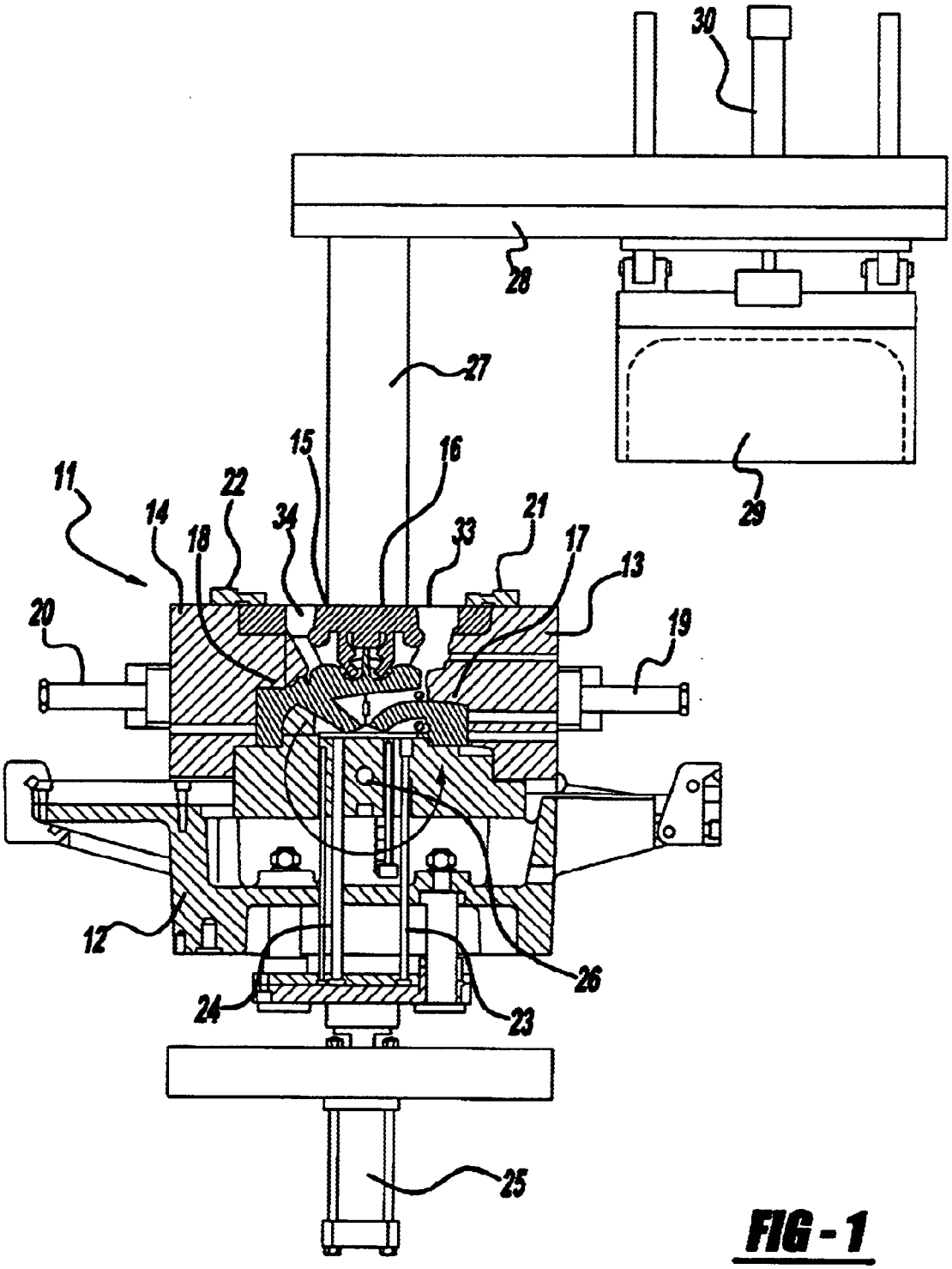
FIG. 1 is a plan view partially in section of an inventive mold in a first position after having been assembled.
Figure 2:
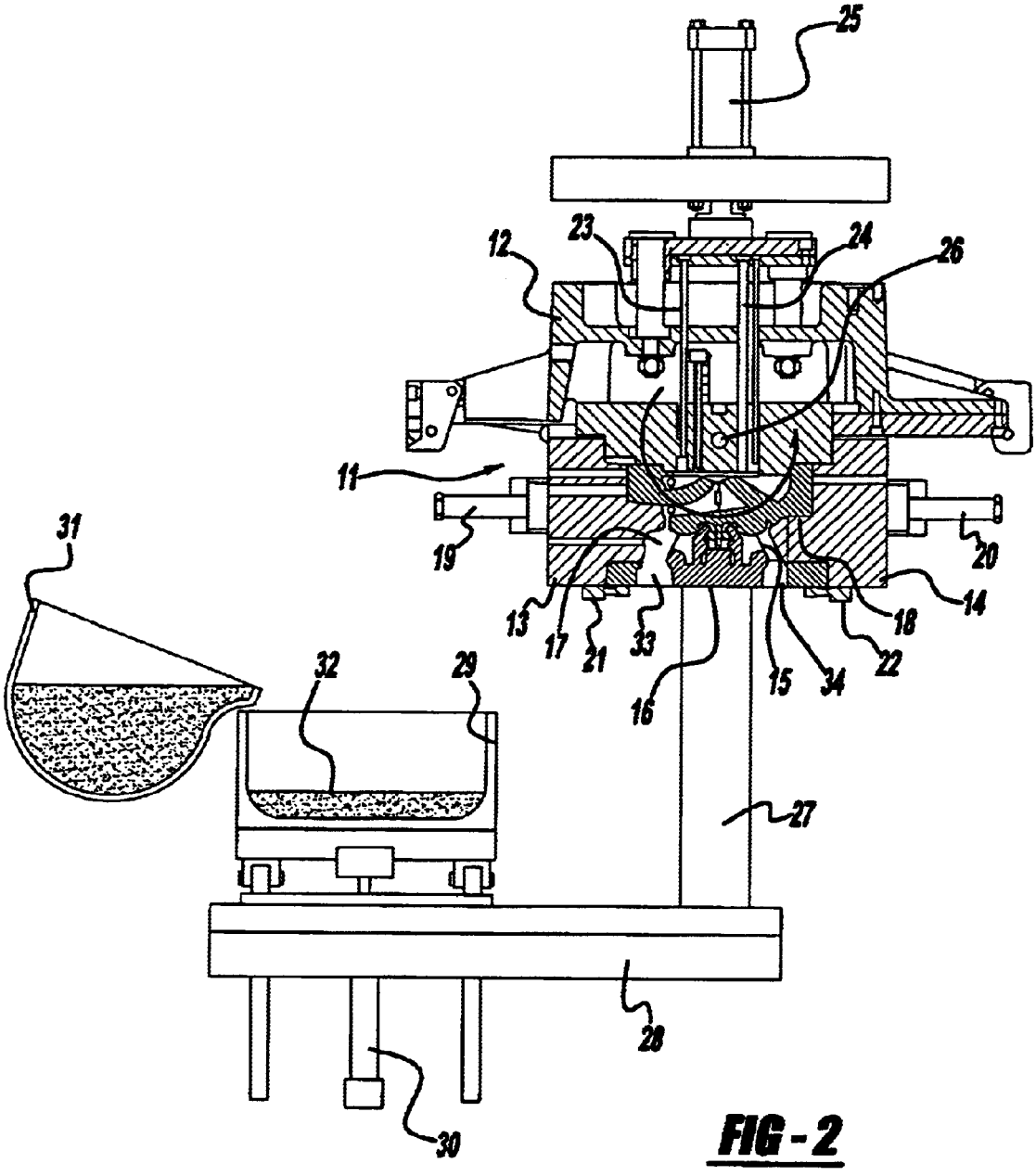
FIG. 2 is a plan view partially in section of the inventive mold in a second position before the casting process starts.

FIGS. 1 and 2 will be described jointly. An inventive mold 11 includes a multi-component base plate 12, side parts 13, 14, each in the form of permanent mold parts, a plurality of inner cores 15, stacked in several layers one above the other on the base plate 12, and a covering core 16. The inner cores 15 and cover core 16 each are of molding material. The plurality of inner cores 15 are clamped in between the base plate 12 and the covering core 16. A continuous clamping force exists on the inner cores 15.

The side parts 13, 14 include mold projections 17, 18. The mold projections 17, 18 additionally hold individual inner cores 15 against the base plate 12. Setting cylinders 19, 20 displace the side parts 13, 14 in opposite directions relative to the base plate 12. The cylinders 19, 20 can be moved away from one another relative to the illustrated position. Thereafter, the inner cores 15 can be stacked on the base plate 12. Following this operation, the side parts 13, 14 can again be closed, as indicated by the arrows pointing in opposite directions. Once again, the side parts 13, 14 return to the indicated position. The covering core 16 is then placed in position.

Bolts 21, 22 are arranged on the side parts 13, 14. The bolts 21, 22 enable assembly and may be slid back relative to the side parts 13, 14. After the covering core 16 has been placed in position, the bolts 21, 22 may be moved forward into the illustrated position. Here, the bolts 21, 22 hold the covering core 16 relative to the inner core 15 and the side parts 13, 14.

The base plate 12 has ejectors 23, 24 which are actuated by a setting cylinder 25. The ejectors 23, 24 remove the casting from the mold. The base plate 12 and thus the entire mold 11 can be rotated around a horizontal axis 26. The axis 26 extends perpendicular relative to the drawing plane.

Column 27 supports a pivot arm 28 which carries a casting container 29. The casting container can be displaced by a setting cylinder 30 parallel to the column 27 on the pivot arm 28. Also, the column 27 may be rotated about the axis 26.

FIG. 1 shows the finish-assembled mold 11 in its position assumed directly after the stacking operation. The casting container 29 is suspended upside down. The casting container 29 has been removed by the setting cylinder 30 from the mold 11. Also, the casting container 29 has been pivoted by the pivot arm 28 on the column 27, by 90° relative to the mold.

In FIG. 2, the mold 11, together with the column 27 and the casting container 29, has been rotated by 180° around axis 26. The casting container 29 is still in the same position relative to the mold 11 as shown in FIG. 1. However, the casting container 29 is now open upwards. Also, the casting container 29 is just being filled by a dispensing ladle 31 with melt 32 for one casting operation.

After the casting container 29 is filled, the pivot arm 28 is pivoted 90° relative to the column 27. Thus, the casting container 29 rests underneath the mold 11 in front of the column 27. The casting container 29 is then lifted towards the mold 11 by the cylinder 30 until the casting container 29 rests sealingly against the covering core 16. In the now assumed position, the mold 11 with the coupled casting container 29 is again rotated by 180° around the axis 26. The melt 32, weighed to fill the mold cavity, flows through the ingate 33 into the mold cavity. Gas in the cavity is able to escape from the gas exit 34 in the casting container 29. After completion of the rotating operation and the casting operation, once again the mold 11 assumes the position as shown in FIG. 1. The casting container 29 is lifted by the setting cylinder 30 from the mold 11 and rotated by the pivot arm 28 back into the position as shown in FIG. 1. After the metal has solidified, the casting can be removed from the mold by withdrawing the side parts 13, 14 and actuating the ejectors 23, 24.

The side parts 13, 14 may be of molding material. In this case, the bolts 21, 22 are replaced by hold-down devices connected to the base plate.

Figure 3:
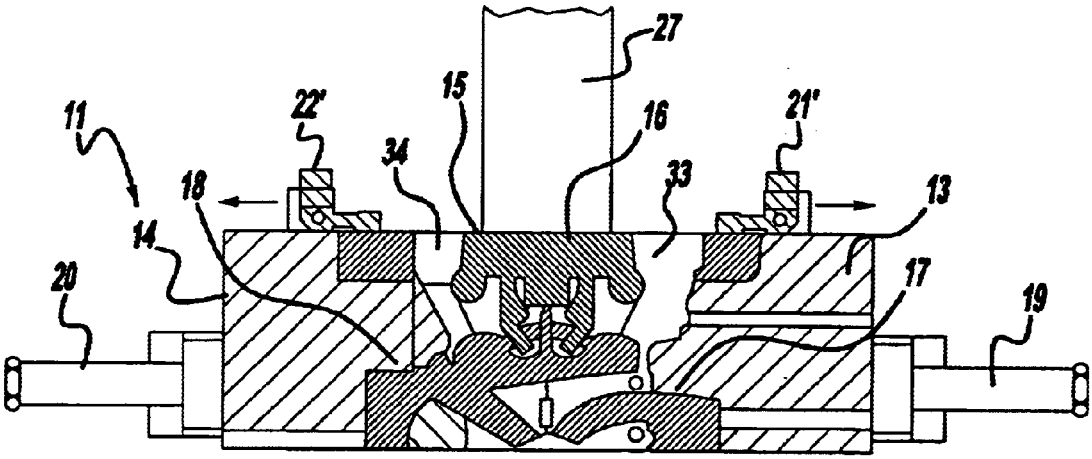
FIG. 3 is a plan view partially in section of a second embodiment of the present invention.

FIG. 3 illustrates a second embodiment of the present invention. Here, the elements which are the same are designated with the same reference numerals. Here, pivotable claws 21', 22' replace bolts 21, 22. The claws 21', 22' are arranged at the side parts 13, 14. However, the claws 21'22' may be at the base plate.

While the above detailed description describes the preferred embodiment of the present invention, the invention is susceptible to modification, variation and alteration without deviating from the scope and fair meaning of the subjoined claims.

What is claimed is:

1. A mold comprising: metal outer mold parts, and inner cores and a covering core, the inner cores and the covering core being made of molding material;

the inner cores being stacked in several layers one above the other, the inner cores clamped in between the outer mold parts and the covering core, a continuous clamping force being applied between the covering core, the inner cores, and the outer mold parts; and a mold cavity being formed by surfaces of the outer mold parts, surfaces of the inner cores and the covering core;

the outer mold parts include a base plate and several side parts which are mechanically connected to and movable relative to said base plate; and the mold is suspended so as to be rotatable around a horizontal axis.

2. The mold according to claim 1, wherein the side parts comprising two longitudinal side parts which can be displaced relative to the base plate outwardly away from the mold cavity in opposite directions.

3. The mold according to claim 1, wherein the side parts comprise at least one end side part which can be moved relative to the base plate outwardly away from the mold cavity.

4. The mold according to claim 1, wherein displaceable bolts are arranged at least at two side parts for holding the cover core.

5. The mold according to claim 1, wherein pivotable claws are arranged at least at two side parts for holding the covering core.

6. The mold according to claim 1, wherein mold projections are provided at the inner faces of the side parts which additionally hold individual cores relative to the base plate.

7. The mold according to claim 1, wherein ejectors are arranged in the base plate.

8. The mold according to claim 1, wherein at least one ingate aperture and at least one gas exit aperture being in the covering core.

9. Making use of a mold according to claim 1, comprising:

rotating the mold after having been stacked on the base plate by 180° around the horizontal axis;

positioning a casting container containing melt for one casting operation from below such that its aperture sealingly rests against the covering core;

rotating the mold together with the contacting casting container by 180° around said horizontal axis with the melt reaching the mold through an ingate in the covering core; and removing the casting container upwardly from the mold.

10. Making use of a mold according to claim 9, comprising:

identifying a longitudinal extension of the mold cavity, rotating the mold around a horizontal axis which extends parallel to the longitudinal extension of the mold cavity.

* * * * *

UNITED STATES PATENT AND TRADEMARK OFFICE

CERTIFICATE OF CORRECTION

PATENT NO. : 6,662,857 B2
DATED : December 16, 2003
INVENTOR(S) : Peter Willfort et al.

It is certified that error appears in the above-identified patent and that said Letters Patent is hereby corrected as shown below:

Column 4,
Line 10, after "plate", insert -- for enabling said parts to be moved away from one another enablishg stacking of said inner cores and moving said side parts back together after the stacking of the inner cores --

Signed and Sealed this

Thirteenth Day of April, 2004

JON W. DUDAS
*Acting Director of the United States Patent and Trademark Office*